US005622007A

United States Patent [19]

Archer

[11] Patent Number: 5,622,007

[45] Date of Patent: Apr. 22, 1997

[54] SLIDING DOOR CLOSING DEVICE

[76] Inventor: Steven L. Archer, 2834 Wells Rd., Irving, Tex. 75061

[21] Appl. No.: 490,642

[22] Filed: Jun. 15, 1995

[51] Int. Cl.[6] ..... E05D 15/06

[52] U.S. Cl. ..... 49/404

[58] Field of Search ..... 49/404, 386, 379, 49/394; 16/71, 72, 73, 80, 84

[56] References Cited

U.S. PATENT DOCUMENTS

| | | | |
|---|---|---|---|
| 22,874 | 2/1859 | Hudson | 16/80 |
| 184,166 | 11/1876 | Myers | 16/80 |
| 1,646,406 | 10/1927 | Isley | 16/80 |
| 2,573,160 | 10/1951 | Norman | 49/379 |
| 3,561,161 | 2/1971 | Green | 16/80 X |
| 3,887,962 | 6/1975 | Mills | 16/72 |
| 4,471,575 | 9/1984 | Stout et al. . | |
| 5,131,188 | 7/1992 | Hutchison et al. . | |
| 5,251,402 | 10/1993 | Richardson et al. . | |
| 5,285,596 | 2/1994 | Kinsey . | |
| 5,313,739 | 5/1994 | Nelson et al. . | |

FOREIGN PATENT DOCUMENTS

| | | |
|---|---|---|
| 5026801 | 10/1977 | Japan . |
| 436205 | 2/1992 | Japan . |

*Primary Examiner*—Kenneth J. Dorner
*Assistant Examiner*—Jerry Redman
*Attorney, Agent, or Firm*—Fulbright & Jaworski L.L.P.

[57] ABSTRACT

There is disclosed an automatic sliding door closing device comprised of two elongated arms coupled together at their proximal ends by a coiled spring which spreads the distal ends of the elongated arms apart. The distal end of one elongated arm is attached to a door jamb and the distal end of the other elongated arm is attached to the edge of the sliding door. Speed damping is provided by a pneumatic cylinder which retards the acceleration of the sliding door due to the force exerted by the coiled spring.

50 Claims, 3 Drawing Sheets

FIG. 2
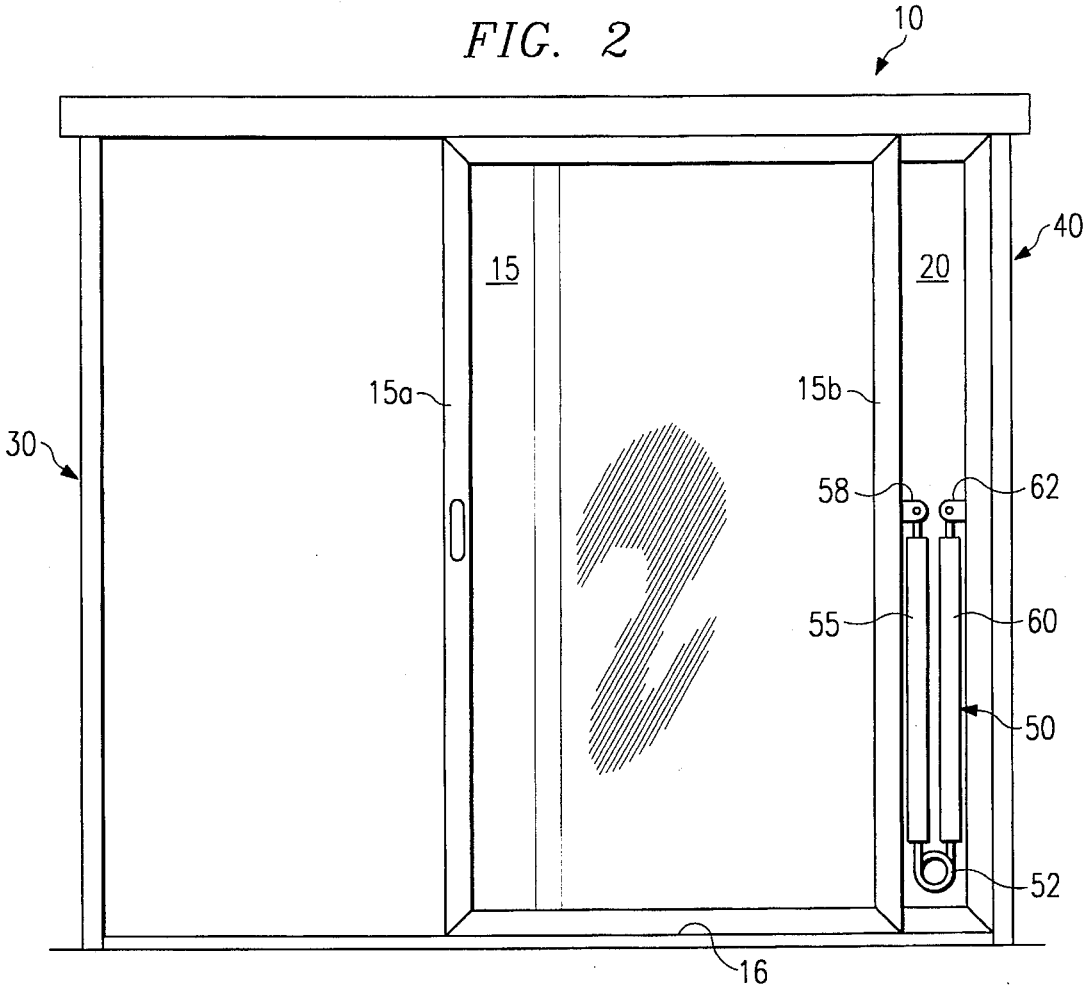
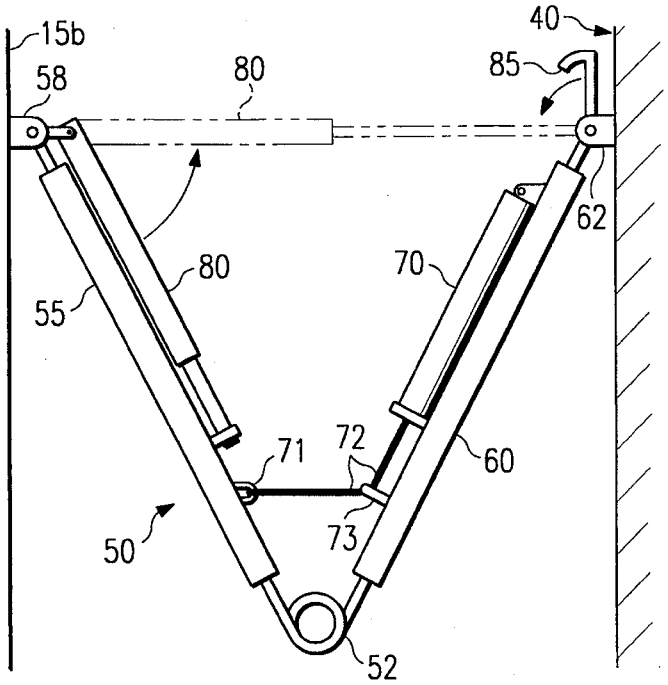
FIG. 3

FIG. 4A
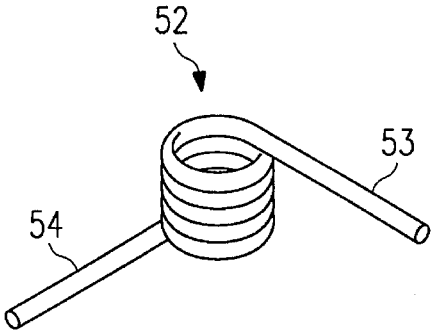
FIG. 4B
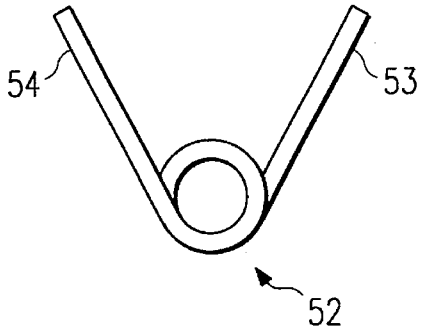
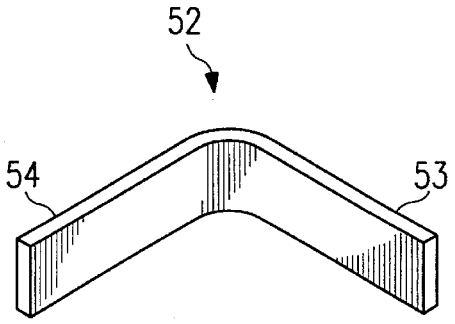
FIG. 4C
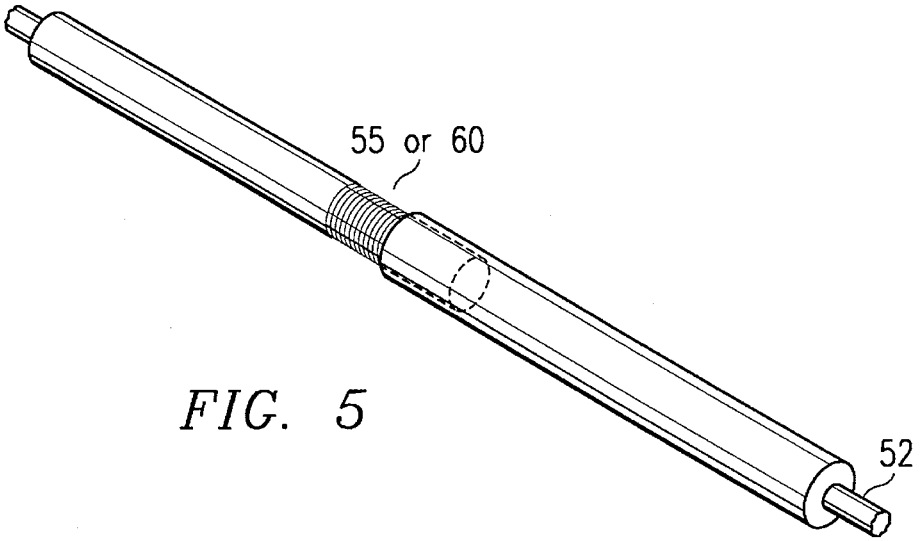
FIG. 5

SLIDING DOOR CLOSING DEVICE

TECHNICAL FIELD OF THE INVENTION

This invention relates to a device for closing any sliding panel, and in particular to a door-frame mounted, spring operated device for closing sliding glass doors.

BACKGROUND OF THE INVENTION

There are numerous devices disclosed in the prior art for automatically closing doors, especially sliding doors. All of these devices, however, suffer from one drawback or another.

Many prior art references, such as U.S. Pat. No. 5,251,402 to Richardson et al., U.S. Pat. No. 5,285,596 to Kinsey, and U.S. Pat. No. 5,131,188 to Hutchison et al., disclose self-contained automatic door closure mechanisms that are either built into the wall of the building or the door-frame of the sliding glass door. These devices are of little value, obviously, to property owners having sliding glass doors that were not equipped with these self-contained door closure mechanisms when originally installed. These self-contained door closure mechanisms are also undesirable due to their high cost and the extreme difficulty involved in repairing or replacing these devices.

Other prior art references, such as U.S. Pat. No. 5,313,739 to Nelson et al. and U.S. Pat. No. 4,471,575 to Stout, disclose externally mounted mechanisms for automatically closing sliding doors. These devices, however, also have several drawbacks. First, these devices are mounted on the outer surface of the sliding door and near its top edge, rather than lying within the flat plane of the sliding track, and therefore distract from the overall streamlined appearance of the sliding door. These devices also require mounting plates and screws that damage any finished wood trim around the door frame. Furthermore, these devices employ one or more elongated helical springs that are stretched when the door is opened and then contract to close the door. Over time, the center sections of the elongated helical springs will experience mechanical stress that causes the springs to slacken and lose their resiliency. Lastly, these devices also have an inordinately large number of moving parts and are of a generally "flimsy" design.

There is therefore a need for an automatic door closure mechanism for sliding glass doors that may be quickly and easily attached to the exterior of sliding glass doors.

There is also a need of an automatic sliding door closure mechanism that can be mounted within the plane of the sliding track so as not to affect the outline or contours of the sliding door.

There is a still further need for a sliding glass door closure device which is of a relatively sturdy construction and which does not use elongated helical springs that slacken and lose resiliency under repeated mechanical stress.

SUMMARY OF THE INVENTION

The present invention overcomes the deficiencies of the prior art by providing an automatic door closure device that easily mounts between the back edge of the sliding door and the door jamb, and which lies within the plane of the sliding door and the sliding track.

In one embodiment of the present invention there is provided an automatic door closure mechanism comprised of a first elongated arm attached to the back edge of the sliding door and a second elongated arm attached to the door jamb. These two arms are coupled to each other by a coiled steel spring which exerts an outward spreading force on the two arms that causes them to open into a wide "V".

It is a feature of the present invention to provide an automatic door closure mechanism which provides a steady, controlled closing of the sliding door in order to prevent the sliding door from moving too rapidly and slamming shut.

It is a further feature of the present invention to provide an automatic door closure device which can be locked in the closed position when desired.

It is a still further feature of the present invention to provide an automatic door closure mechanism which can be easily detached from the sliding glass door and stored in a folded position when desired.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 2 is a front elevational view of the sliding door shown in FIG. 1, with the door in the open position;

FIG. 3 is a front elevational view of the present invention further including a pneumatic cylinder for controlling the speed at which the sliding door is closed by the present invention;

FIG. 4A is a perspective view of the coiled spring used in the present invention;

FIG. 4B is a bottom view of the coiled spring shown in FIG. 4A;

FIG. 4C is a perspective view of the flat spring used in a preferred embodiment of the present invention; and FIG. 5 is a partial view of a preferred embodiment of cylinder 55 or 60 including threaded sections to allow for adjustment in length.

DETAILED DESCRIPTION OF THE INVENTION

Figure 1:
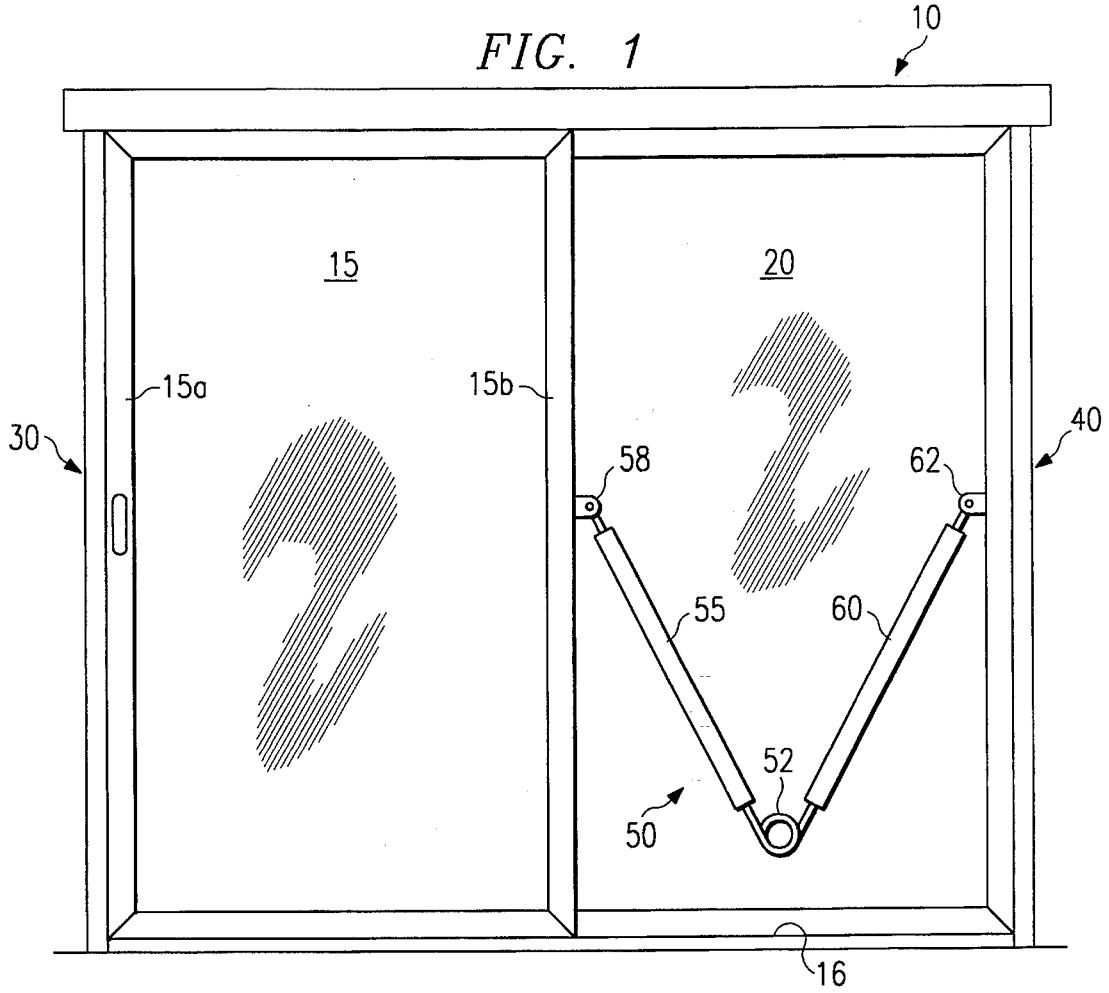
FIG. 1 is a front elevational view of a sliding door on which the present invention is mounted.

For the purpose of simplicity and clarity, the following description discusses the situation where the present invention is mounted on sliding glass doors, such as are typically found in residences. However, this is but one example of a use of the present invention and it should be readily understood that the door closing mechanism of the present invention may be used on any type of sliding panel. In particular, the present invention may be used in those situations where in is undesirable to use a conventional hinge-mounted swinging door (due to crowded room conditions) and one or more sliding door panels contained within a wall are preferred to a swinging door. The present invention may easily be installed inside of a wall for use in conjunction with sliding doors.

FIG. 1 depicts sliding glass door 10 comprised of sliding glass panel 15 and stationary glass panel 20. Sliding glass panel 15 is shown in the closed position, wherein leading edge 15*a* of sliding glass panel 15 is flush against door jamb 30. Door closure 50 of the present invention is mounted between trailing edge 15*b* of sliding glass panel 15 and door jamb 40. Mounting bracket 58 and mounting bracket 62 connect door closure 50 to sliding glass panel 15 and door jamb 40, respectively. Door closure 50 hangs vertically in front of stationary glass panel 20, above track 16 in which sliding glass panel 15 moves, and in the same vertical plane as sliding glass panel 15.

Door closure 50 is comprised of coiled spring 52, elongated tube 55 and elongated tube 60. Elongated tube 55 is rotatably coupled to mounting bracket 58 and elongated tube 60 is rotatably coupled to mounting bracket 62. In the open position (door closed) shown in FIG. 1, coiled spring 52 is maintained slightly in tension in order to apply a relatively small "spreading" force to elongated tube 55 and elongated tube 60 and thereby maintain pressure to keep sliding glass panel 15 closed against door jamb 30.

FIG. 2 depicts sliding glass door 10 with sliding glass panel 15 in the open position. Sliding glass panel 15 compresses door closure 50, such that elongated tube 55 and elongated tube 60 move from an open "V" position, as shown in FIG. 1, to an approximately parallel position. In this position, coiled spring 52 is under maximum tension and is applying a maximum "spreading" force to elongated tube 55 and elongated tube 60. When the person or mechanical agent that has opened sliding glass panel 15 releases pressure from sliding glass panel 15, the "spreading" force exerted by coiled spring 52 on elongated members 55 and 60 will force sliding glass panel 15 to the left, or to the closed position.

The force exerted by coiled spring 52 will exert a continuous acceleration to sliding glass panel 15 throughout the entire range of motion as sliding glass panel 15 moves from the open position to the closed position. This means that sliding glass panel 15 will be moving at a maximum speed when leading edge 15*a* strikes door jamb 30. It is therefore desirable, in a preferred embodiment of the present invention, to provide a method of controlling the acceleration and speed of sliding glass panel 15. As will be shown below, there are numerous ways to provide speed control to the present invention.

FIG. 3 depicts one embodiment of door closure 50, wherein speed damper 70, mounted on elongated tube 60 causes sliding glass panel 15 to slide to a closed position in a relatively controlled and gentle manner to thereby prevent sliding glass panel 15 from closing too quickly. In a preferred embodiment, speed damper 70 is a pneumatic cylinder which uses controlled release of air to control the speed at which sliding glass panel 15 moves. As door closure 50 opens, elongated tube 55 pulls cable 72 by means of connector 71 through fair lead 73. The distal end of cable 72 is connected to a piston (not shown) inside of speed damper 70. The piston is slowed in its movement by the controlled release of air pressure within damper 70 or by the passage of the piston through some viscous medium, such as oil.

It should be understood that there are a variety of different ways in which speed damper 70 may be mounted on door closure 50 or on the frame of sliding glass door 10 in order to control the speed at which sliding glass panel 15 moves. In FIG. 3, speed damper 70 is shown mounted on the "top" of elongated tube 60 (i.e., in the gap between elongated tube 55 and elongated tube 60). Speed damper 70, however, may also be mounted on the "bottom" of elongated tube 60 (i.e. between elongated tube 60 and door jamb 40), or may be mounted on elongated tube 55, instead.

In situations where space is limited, and it is not practical to mount speed damper 70 between elongated tubes 55 and 60, or between elongated tube 60 and door jamb 40, speed damper 70 may, for example, be mounted on the "outside" of elongated tube 60 (i.e. closer to a viewer of FIG. 3).

In an alternate embodiment of the present invention, speed damper 70 may instead be mounted along door jamb 40. In such a case, fair lead 73 would also be mounted somewhere along door jamb 40 and speed control would be provided by controlling the rate at which connector 71 (and elongated tube 55) move away from door jamb 40.

In still another embodiment of the present invention, speed control may be gained by adjusting the length of elongated tube 55 and elongated tube 60. In a preferred embodiment of the present invention, elongated tube 55 and elongated tube 60 are telescopic and may be adjusted in length both to suit the size of the door and the speed at which the sliding glass panel 15 opens. Each elongated tube may be comprised of an outer tube and an inner tube, where the length is adjusted by using threaded sections, as shown in FIG. 5, or by using a spring-mounted dowel in the inner tube and a plurality of holes in the outer tube.

Increasing the length of elongated tube 55 and elongated tube 60 controls the speed at which sliding glass panel 15 opens in a straightforward manner. Elongated tubes 55 and 60 act as mechanical levers with respect to coiled spring 52 and each other. A mechanical advantage may be gained by increasing the effective length of each lever. The weight of sliding glass panel 15 and friction with the sliding track both apply a counterforce to elongated tube 55 which coiled spring 52 must overcome. By doubling the length of elongated tube 55, for example, the effective force of resistance exerted by glass panel 15 can be doubled. In this manner, the rate of acceleration applied to sliding glass panel 15 by coiled spring 52 may be greatly reduced.

Additionally, speed control may be provided by combining speed damper 70 with variable length elongated tubes 55 and 60 in a single embodiment. However, speed control may be effectively provided by either method individually.

FIG. 3 also depicts optional locking mechanism 80 coupled to mounting bracket 58 for use in maintaining sliding glass panel 15 locked in the closed position. Many homeowners employ a metal rod that is placed from trailing edge 15*b* of sliding glass panel 15 to door jamb 40 in the floor track in which sliding glass panel 15 moves. These metal rods typically cover nearly the entire length of the exposed track when sliding glass door 15 is in the closed position and prevent sliding glass door 15 from sliding back to the open position. These metal bars are often mounted on a pivot at floor level on door jamb 40 and are rotated upward into the vertical position when not used.

However, since the use of door closure 50 might interfere with the rotating motion of such a metal rod, a preferred embodiment of door closure 50 employs locking bar 80, a metal rod of adjustable length, coupled to mounting bracket 58, which lays along the length of elongated tube 55, and in close proximity to elongated tube 55, when not in use. Locking bar 80 may also be stored by rotating upward and locking into place against trailing edge 15*b* of sliding glass panel 15.

Preferably, locking bar 80 is pivotally mounted to mounting bracket 58, rather than mounting bracket 62. This prevents burglars from slipping a wire coat hanger or similar device through the narrow seal between sliding glass panel 15 and stationary glass panel 20 and dislodging the free end of locking bar 80, which would be located proximate trailing edge 15*b* of sliding glass panel 15 if locking bar 80 were pivotally mounted on mounting bracket 62 instead of mounting bracket 58.

In a preferred embodiment of the present invention, mounting brackets 58 and 62 are quick-release brackets that allow door closure 50 to be rapidly removed from the sliding door. Additionally, a latch 85 may be mounted on door closure 50, at or near mounting bracket 62, that fastens to mounting bracket 58 when the door is open and prevents coiled spring 52 from spreading elongated tubes 55 and 60 apart again. In this way, door closure 50 may be de-activated without removing it from the door frame. In other embodiments, latch 85 may be mounted on mounting bracket 58 and fasten to mounting bracket 62, and a chain may be used instead of a latch.

FIGS. 4A and 4B are a perspective view and a bottom view, respectively, of coiled spring 52. In one embodiment of the present invention, coiled spring 52 is cylindrically wound and has leg 53 and leg 54 positioned approximately 90° apart. For durability, a comparatively rugged spring of 0.25 inch thick steel is used. In a preferred embodiment of the present invention, coiled spring 52 has 8.25 coils with an inside diameter of approximately 2 inch, an outside diameter of approximately 2.5 inch, and a rate of 1.6237 inch-pounds per degree of rotation.

In other embodiments of the present invention, other types of springs, such as flat springs may be used. In cases where a flat spring is used, the spring is pre-bent at approximately a 90° angle when in a relaxed position, as shown in FIG. 4C.

The speed at which door closure 50 closes sliding glass panel 15 may also be controlled by bending (or crimping) leg 53 and leg 54 of coiled spring 52. Bending leg 53 and leg 54 inward will reduce the spreading force exerted by coiled spring 52 at any given position of sliding glass panel 15. Conversely, bending legs 53 and 54 apart will increase the amount of spreading force exerted by coiled spring 52 at any given position of sliding glass panel 15.

In an alternate embodiment, the present invention may be used to open doors by closing elongated tubes 55 and 60 together. This is accomplished by providing a coiled spring similar to coiled spring 52 that, in a relaxed state, has two approximately parallel legs. Since the legs are normally parallel when not under stress, the relaxed state of the present invention would be as shown in FIG. 2. When sliding glass panel 15 is forcibly closed, as in FIG. 1, elongated tubes 55 and 60 would force coiled spring 52 open into a tensed position. In such an embodiment, speed damper 70 would use a controlled use of air to slow the rate at which coiled spring 52 opens sliding glass panel 15.

Although the present invention and its advantages have been described in detail, it should be understood that various changes, substitutions and alterations can be made herein without departing from the spirit and scope of the invention as defined by the appended claims.

What is claimed is:

1. A device for closing a sliding panel, said device comprising:

a first arm having a first end and a second end;

means for coupling said first end of said first arm to a sliding panel;

a second arm having a first end and a second end;

means for coupling said first end of said second arm to a fixed structure; and a spring providing a torsion force coupled to said second end of said first arm and said second end of said second arm, said spring providing the only pivotal connection between said first arm and said second arm, wherein said spring is operable to exert a force on said first arm and said second arm to spread apart said first arm and said second arm.

2. The device as set forth in claim 1 wherein said first end of said first arm is adapted for coupling to an edge of said sliding panel.

3. The device as set forth in claim 1 wherein said first end of said second arm is adapted for coupling to a door frame in which said sliding panel is slidably mounted.

4. The device as set forth in claim 1 wherein said spring is a coiled spring.

5. The device as set forth in claim 1 wherein said spring is a flat spring, said flat spring having a first end and a second end, said flat spring being pre-bent to form a single arc with said first end being radially deflected from said second end by a predetermined amount when said flat spring is in a relaxed state.

6. The device as set forth in claim 1 further comprising damper means for controlling the speed at which said first arm and said second arm spread apart under said force of said spring.

7. The device as set forth in claim 6 wherein said damper means comprises a pneumatic cylinder.

8. The device as set forth in claim 7 wherein said pneumatic cylinder comprises a sliding piston disposed in a cylindrical vessel, said cylindrical vessel being substantially permanently mounted on a selected one of said first arm or said second arm and said sliding piston being in mechanical communication with an other selected one of said first arm or said second arm, said mechanical communication providing resistance to the exertion of a force on said first arm and said second arm by said spring.

9. The device as set forth in claim 7 wherein said pneumatic cylinder is adapted for mounting on said fixed structure and coupled to a selected one of said first arm or said second arm.

10. The device as set forth in claim 1 wherein the length of said first arm and the length of said second arm are each adjustable.

11. The device as set forth in claim 1 further comprising means for preventing said first arm and said second arm from spreading apart.

12. The device as set forth in claim 1 further comprising a locking bar having a first end mounted on one of said arms and a second end adapted for coupling with the other of said arms to thereby prevent said arms from closing together.

13. The device as set forth in claim 12 wherein the length of said locking bar is adjustable.

14. The device as set forth in claim 1 further comprising damper means for controlling the speed at which said first end of said first arm and said first end of said second arm spread apart under said force of said spring.

15. The device as set forth in claim 14 wherein said damper means comprises a pneumatic cylinder.

16. The device as set forth in claim 15 wherein said pneumatic cylinder is mounted longitudinally on a selected one of said first arm or said second arm, said pneumatic cylinder having a piston, said piston being flexibly coupled to an other selected one of said first arm or said second arm.

17. The device as set forth in claim 15 wherein said pneumatic cylinder is adapted for mounting on said fixed structure and coupled to a selected one of said first arm or said second arm.

18. A device for closing a sliding panel slidably mounted in a frame, said device comprising:

a first arm having a first end;

means for coupling said first arm to an edge of a sliding panel;

a second arm having a first end;

means for coupling said second arm to a jamb of a frame; and a spring having a first end coupled to a second end of said first arm and a second end coupled to a second end of said second arm, said spring disposed between said first arm and said second arm to provide the only pivotal connection between said first arm and said second arm, wherein said spring is operable to exert a force on said first arm and said second arm operable to spread apart said first end of said first arm and said first end of said second arm.

19. The device as set forth in claim 18 wherein said spring is a coiled spring.

20. The device as set forth in claim 18 wherein said spring is a flat spring.

21. The device as set forth in claim 18 wherein the length of said first arm and the length of said second arm are adjustable.

22. The device as set forth in claim 18 further comprising a latch mounted on a first selected one of said first arm or said second arm for preventing said first arm and said second arm from spreading apart.

23. The device as set forth in claim 18 further comprising a locking bar having a first end mounted on said first arm and a second end adapted for coupling with said second arm to thereby prevent said first arm and said second arm from closing together.

24. The device as set forth in claim 23 wherein the length of said locking bar is adjustable.

25. A sliding door comprising:

a door frame;

a sliding door panel slidably mounted in said door frame;

a door closure for closing said sliding door panel against a first jamb of said door frame, said door closure comprising:

a first arm having a first end coupled to said sliding door panel;

a second arm having a first end coupled to a second jamb of said door frame; and a spring providing a torsion force formed as a second end of said first arm and as a second end of said second arm, said spring providing the only pivotal connection between said first arm and said second arm, wherein said spring is operable to exert a force on said first arm and said second arm to spread apart said first arm and said second arm.

26. The sliding door as set forth in claim 25 wherein said first end of said first arm is coupled to an edge of said sliding door panel.

27. The sliding door as set forth in claim 25 wherein said spring is a coiled spring.

28. The sliding door as set forth in claim 25 wherein said spring is a flat spring, said spring having a first end and a second end, said flat spring being pre-bent to form a single arc with said first end being radially deflected from said second end by a predetermined amount when said spring is in a relaxed position.

29. The sliding door as set forth in claim 25 further comprising damper means for controlling the speed at which said first arm and said second arm spread apart under said force of said spring.

30. The sliding door as set forth in claim 29 wherein said damper means comprises a pneumatic cylinder.

31. The sliding door as set forth in claim 30 wherein said pneumatic cylinder comprises a sliding piston disposed in a cylindrical vessel, said cylindrical vessel being substantially permanently mounted on said second arm and said sliding piston being in mechanical communication with said first arm, said mechanical communication providing resistance to the exertion of a force on said first arm and said second arm by said spring.

32. The sliding door as set forth in claim 30 wherein said pneumatic cylinder is adapted for mounting on said second jamb of said door frame and coupled to a selected one of said first arm or said second arm.

33. The sliding door as set forth in claim 25 wherein the length of said first arm and the length of said second arm are each adjustable.

34. The sliding door as set forth in claim 25 further comprising means for preventing said first arm and said second arm from spreading apart.

35. The sliding door as set forth in claim 25 further comprising a locking bar having a first end mounted on one of said arms and a second end adapted for coupling with the other of said arms to thereby prevent said arms from closing together.

36. The sliding door as set forth in claim 35 wherein the length of said locking bar is adjustable.

37. A device for opening a sliding panel, said device comprising:

a first arm having a first end including means for coupling said first arm to said sliding panel, said first arm also having a second end, said second end being disposed at a distal end of said first arm from said first end;

a second arm having a first end including means for coupling said second arm to a fixed structure, said second arm also having a second end, said second end being disposed at a distal end of said second arm from said first end; and a fixed length dual ended spring the ends of which pivot about a deflection point, one end of the spring forming the second end of the first arm and the other end of the spring forming the second end of the second arm, said spring providing the only pivotal connection between said first arm and said second arm, wherein said spring is operable to exert a force on said first arm and said second arm to close together said first arm and said second arm.

38. The device as set forth in claim 37 wherein said first end of said first arm is adapted for coupling to an edge of said sliding panel.

39. The device as set forth in claim 37 wherein said first end of said second arm is adapted for coupling to a door frame in which said sliding panel is slidably mounted.

40. The device as set forth in claim 37 wherein said spring is a coiled spring.

41. The device as set forth in claim 37 wherein said spring is a flat spring.

42. The device as set forth in claim 37 further comprising damper means for controlling the speed at which said first arm and said second arm close together under said force of said spring.

43. The device as set forth in claim 42 wherein said damper means comprises a pneumatic cylinder.

44. The device as set forth in claim 43 wherein said pneumatic cylinder is mounted on said first arm said mounted pneumatic cylinder being substantially parallel to said first arm, said pneumatic cylinder having a piston, said piston being in mechanical communication with said second arm.

45. The device as set forth in claim 43 wherein said pneumatic cylinder is adapted for mounting on said fixed structure and coupled to a selected one of said first arm or said second arm.

46. The device as set forth in claim 37 wherein the length of said first arm and the length of said second arm are each adjustable.

47. The device as set forth in claim 37 further comprising a locking bar having a first end mounted on one of said arms and a second end adapted for coupling with the other of said arms to thereby prevent said arms from closing together.

48. The device as set forth in claim 47 wherein the length of said locking bar is adjustable.

49. A device controlling the movement of a door, the movement of the door including a closed position and an open position, the open position being such that an edge of the door moves into close proximity to a fixed structure, said device comprising:

a resilient fixed length dual ended member the ends of which pivot about a torsion point, one end of the member comprising means for attaching to a fixed point on a door and a second end of the member comprising means for attaching to a fixed point on a fixed structure;

the torsion point providing the only pivotal connection between the member ends and exerting a force causing the member ends to resile upon deflection from a rest state.

50. The device as set forth in claim 49 wherein the torsion point includes at least one loop of material having a high degree of mechanical memory.

* * * * *